US006038786A

United States Patent [19]

Aisenberg et al.

[11] Patent Number: 6,038,786

[45] Date of Patent: Mar. 21, 2000

[54] HAND DRYER

[75] Inventors: Sol Aisenberg, Natick; George Freedman, Wayland, both of Mass.; A. Ze'ev Hed, Nashua, N.H.; Richard Pavelle, Lexington, Mass.

[73] Assignee: Excel Dryer Inc., East Longmeadow, Mass.

[21] Appl. No.: 09/061,453

[22] Filed: Apr. 16, 1998

[51] Int. Cl.[7] ..... F26B 3/34

[52] U.S. Cl. ..... 34/267; 34/565; 34/572; 34/702

[58] Field of Search ..... 34/267, 565, 572, 34/90, 91, 97, 98, 202; 392/380, 381, 384, 385; 132/245, 221, 233

[56] References Cited

U.S. PATENT DOCUMENTS

| | | | |
|---|---|---|---|
| 2,392,405 | 1/1946 | Phipps . | |
| 2,512,769 | 6/1950 | Crumrine . | |
| 2,651,705 | 9/1953 | Clemens . | |
| 3,128,161 | 4/1964 | Hudon . | |
| 3,621,199 | 11/1971 | Goldstein . | |
| 3,643,346 | 2/1972 | Lester . | |
| 3,674,980 | 7/1972 | Cox | 34/97 X |
| 3,766,397 | 10/1973 | Rockson . | |
| 3,902,508 | 9/1975 | Sliman, Sr. . | |
| 4,087,924 | 5/1978 | Fujimoro et al. . | |
| 4,197,448 | 4/1980 | Harigai . | |
| 4,226,251 | 10/1980 | Wall . | |
| 4,263,500 | 4/1981 | Springer et al. . | |
| 4,323,761 | 4/1982 | Hubner . | |
| 4,419,835 | 12/1983 | Strain . | |
| 4,464,906 | 8/1984 | Outlaw . | |
| 4,536,198 | 8/1985 | Strain . | |
| 4,754,769 | 7/1988 | Flynn . | |
| 4,876,435 | 10/1989 | Hawkins . | |
| 4,914,273 | 4/1990 | Matsui . | |
| 4,991,314 | 2/1991 | Allen | 34/98 |
| 5,163,234 | 11/1992 | Tsukamoto et al. . | |
| 5,269,071 | 12/1993 | Hamabe et al. . | |
| 5,282,364 | 2/1994 | Cech . | |
| 5,331,747 | 7/1994 | Stanton . | |
| 5,458,458 | 10/1995 | Tada et al. . | |
| 5,459,944 | 10/1995 | Tatsutani et al. . | |
| 5,507,103 | 4/1996 | Merritt . | |
| 5,599,229 | 2/1997 | Claunch et al. | 454/121 |
| 5,668,921 | 9/1997 | Essler . | |

OTHER PUBLICATIONS

Fastaire Hand Dryers, *Hand Dryers,* Apr. 1, 1997, pp. 1–6.

Exair Corporation, Vortex Tubes–Section 1, Cabinet Coolers–Section 2, Camera Cooler–Section 3, Cold Gun Aircoolant Systems And Accessories–Section 4, Component Cooler–Section 5, Needle Cooler–Section 6, Exair–Amplifiers–Section 7, Exair–Knife–Section 8, Exair–Ionizers–Section 9, Exair–Jets and Nozzles–Section 10.

Web Systems, Inc., *The Chinook Ultra–Dryer*™, 4 pgs. ( Apr. 1997)

*Primary Examiner*—Steve Gravini

*Attorney, Agent, or Firm*—Cantor Colburn LLP

[57] ABSTRACT

A wall-mounted hand dryer provides a heated pulsating or modulating air stream to break down a boundary layer of moisture on a user's hands to reduce the drying time. The hand dryer accomplishes this by quickly generating a heated air stream at a maximum temperature that is tolerable to the user, increasing the air stream velocity and turbulence to blow off loose water droplets and break down the boundary layer disposed on the user's hands. The hand dryer includes a blower, heater, a modulator and/or a turbulator for blowing heated air through an air duct. The modulator and turbulator break up the laminar flow of the air stream to provide a modulating or pulsating turbulent flow of air to retard the formation of the boundary layer and dry the hands quickly. The hand dryer further includes an infrared heating source for heating the surface of a user's hands to replace the heat lost as a result of the evaporation of the water from the user's hands. The operation of the hand dryer is controlled by a controller which actuates the components of the hand dryer for a predetermined time period (i.e., 10 seconds) in response to an actuation signal provided by a push button switch or proximity sensors.

49 Claims, 8 Drawing Sheets

HAND DRYER

BACKGROUND OF THE INVENTION

1. Field of the Invention

The present invention relates to drying devices, and more particularly to a drying device adapted for improved and faster drying of a user's hands and hair.

2. Description of the Related Art

Conventional hand dryers dry an individual's wet hands in one of two ways, evaporative drying or "blow off" drying. Conventional evaporative hand dryers include a blower for generating an air stream through a ducting system to an exit nozzle which directs the air stream onto the hands of the user. The air stream is heated by a heating device to evaporate the moisture on the user's hands. The hand dryers generally include a push button or other means to actuate the blower and heater for a predetermined time period (i.e., 30 seconds).

The drying time for these conventional evaporative hand dryers is relatively slow, taking thirty (30) seconds or more to dry a user's hands. The typical commercial hand dryer is rated at 20 amperes at 110 volts which means that it delivers at a rating of 2.2 KW. That is enough energy in 30 seconds to evaporate about 30 grams of water. But the average amount of water on wet hands is three grams or less. Thus, conventional dryers are only about 10 percent energy efficient. The energy loss is a result of the following operating factors: heating up the internal dryer components; not maximizing and optimizing air flow temperature, direction and velocity; not compensating locally for evaporative cooling; and not addressing the problem of a boundary layer of water molecules which inhibits evaporation at the skin surface of the hands. Attempts to improve energy efficiency in the prior art include providing an enclosure for the hands, recirculating air, predrying the air and use of infrared (IR) radiation as the primary heating means.

As mentioned above, a boundary layer of water molecules retard evaporation. When wet systems (i.e., hands) are impinged by an air stream, a layer of very low velocity, very high humidity air forms at the surface which creates a barrier to the transfer of heat and also to the removal of evaporating water. This layer of air which forms at the surface as a result of the difference velocity between surface and air is called a boundary layer or stagnation layer. Since the air in this stagnation layer does not move, it will form a zone in which water molecules leaving the water film surface just below it will accumulate, thus rendering it saturated. Since this layer it not readily swept away, the higher water vapor concentration in the boundary layer results in water molecules in the boundary layer condensing back to the wet film surface, due to random motion, thus reducing the net rate of evaporation.

Conventional hand dryers that use "blow off" or "air knife" technology do not use evaporation (although a small amount occurs) but instead, provide an intensive blast of high velocity air which when suitably deployed, blows or skives droplets of water off the user's hands. The difficulty associated with this technique is that it requires expensive pressure blowers or compressors and nozzles having critically designed apertures. When drying is achieved by blowing away these water droplets, water will accumulate in the vicinity of the machine—walls, floor, the user—unless provisions are made to collect and dispose of the water.

It has been found that after using a conventional "blow off" hand dryer, the hands feel cold and slightly moist, possibly as a result of some presence of the boundary layer of water-saturated air on the hands as well as some cooling due to heat of evaporation from that small portion of the moisture that has evaporated off. Other disadvantages are that the hands must be inserted into a narrow enclosure which provides a collection trough to collect the droplets of blown off water. The collection trough includes a drain hole which feeds a floor level container that requires periodic draining of water by maintenance staff. Further, problems are then introduced in keeping the accumulated water from accumulating mold and bacteria with time. These "blow off" hand dryers are, therefore, inherently complex, noisy, large and expensive while at the same time requiring dedicated ongoing maintenance.

SUMMARY OF THE INVENTION

The above-discussed and other drawbacks and deficiencies of the prior art are overcome or alleviated by the hand dryer of the present invention.

According to the present invention, a hand dryer includes a blower and a heater for blowing heated air through an air duct which exits from an output opening to dry a user's hands. The air duct can shape the air flow geometrically into multiple jets or a monolithic air stream as required. A modulator varies the flow rate and flow pattern of the air flow to pulsate or modulate the air flow. A turbulator disposed adjacent the output opening of the duct mixes the air flow. The pulsed turbulent air flow functions to break down the boundary layer disposed on the surface of the user's hands to reduce the time of drying the user's hands. The operation of the hand dryer is performed by a controller in response to an actuation signal. The actuation signal may be provided by a proximity sensor or a push button. The hand dryer may also include an infrared heating device for heating the surface of the hands to compensate for heat loss due to the evaporation of the water from the user's hands. A plurality of air ducts may be provided to direct opposing air flows that impinge onto the user's hands at a selected angle. The pattern of the exiting air flow may be spread so as to dry both hands at once.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
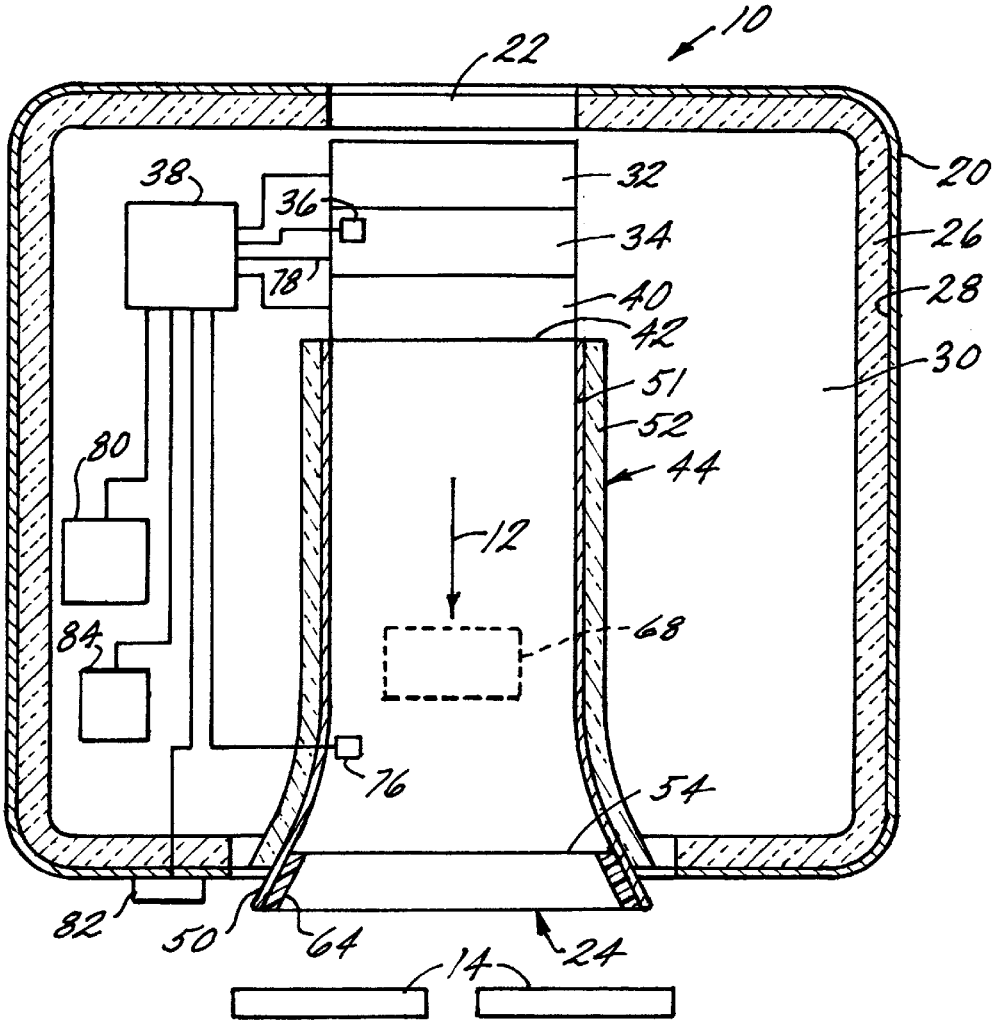
FIG. 1 is front elevational view a hand dryer embodying a preferred embodiment of the present invention.

Referring to FIG. 1, there is shown a wall-mounted hand dryer, generally designated 10, for providing a heated pulsating or modulating air stream 12 to dry a user's hands 14 much faster than conventional hand dryers. The hand dryer 10 of the present invention accomplishes this by quickly generating a heated air stream at a maximum temperature that is tolerable to the user, increasing air stream velocity and turbulence to blow off loose water droplets and breaking down the boundary layer disposed on the user's hands 14, as described hereinbefore.

Figure 2:
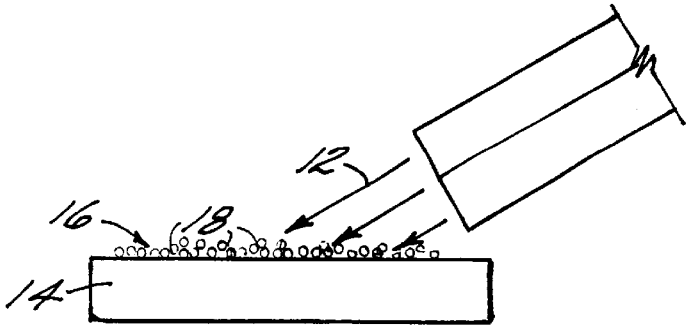
FIG. 2 is a side elevational view of the hand dryer of the present invention breaking down a boundary layer disposed on a user's hand.

It is an important feature of the present invention that the hand dryer 10 provides an air stream 12 to break down or erode a boundary layer or stagnation layer 16 of water disposed on the surface of the hands as shown in FIG. 2. The water film on the hands is essentially stagnant compared to the moving hot air stream 12 that is designed to heat the hand and also remove the evaporating water. As a result of the difference in surface velocity and air velocity, the boundary layer 16 is present at the surface of the hands 14. The air in this boundary layer 16 does not move and will accumulate water molecules 18 leaving the water film surface.

The higher water vapor concentration in the boundary layer 16 results in many of the evaporation water vapor molecules 18 condensing back to the film surface, due to random motion. The net rate of evaporation, therefore, is reduced. The air stream 12 generated by the present invention sweeps away the boundary layer by proper modification of the hot air flow, and will help keep the water vapor concentration above the water film low so that more water molecules 18 can evaporate and escape.

To break up the boundary layer 16, the invention will provide a warm and/or hot air stream 12 that is modified by adding turbulence by pulsing the flow of air and rapidly alternating the direction of air stream 12 exiting the hand dryer 10.

Referring to FIG. 1, the hand dryer 10 includes a housing 20 having an air inlet opening 22 for drawing air into the housing and an air outlet opening 24 for blowing heated air onto the user's wet hands 14. The housing 20 has an insulation layer 26 disposed on its interior walls 28 to prevent radiant and convection cooling of the ambient temperature of the drying chamber 30 of the housing. Insulating all interior walls 28 of the dryer chamber 30 maintains the temperature of the internal components and air for a protracted period, thus eliminating the need to waste time heating them up between users before the air stream 12 attains a desired temperature.

A blower 32 is mounted within the drying chamber 30 of the housing 10 adjacent the inlet opening 22. The blower, when actuated, draws external air through the inlet opening to an electric heater 34. The blower 32 may be a centripetal or axial blower which is powered by electricity, such as but not limited to 110 or 220 Volt AC. To increase the output air pressure and velocity of the blower 32, the blower may include two or more axial blowers mounted to operate in series or parallel.

The heater 34 is disposed after or down flow of the air stream 12 entering from the inlet opening 22 so that no start up drying time is wasted in heating the large mass of the blower 32. Further, the heater 34 is located down flow to eliminate accidental contact by a user. The heater may comprise of a high temperature metal such as nichrome or inconel or of silicon carbide, or other electrically resistive material. The heater 34 further includes a temperature sensor or thermal switch 36 that generates a signal representative of the temperature of the air stream 12 exiting the heater. The temperature signal is provided to a controller 38 which controls the operation of the hand dryer 10, which is described in greater detail hereinafter.

Figure 3:
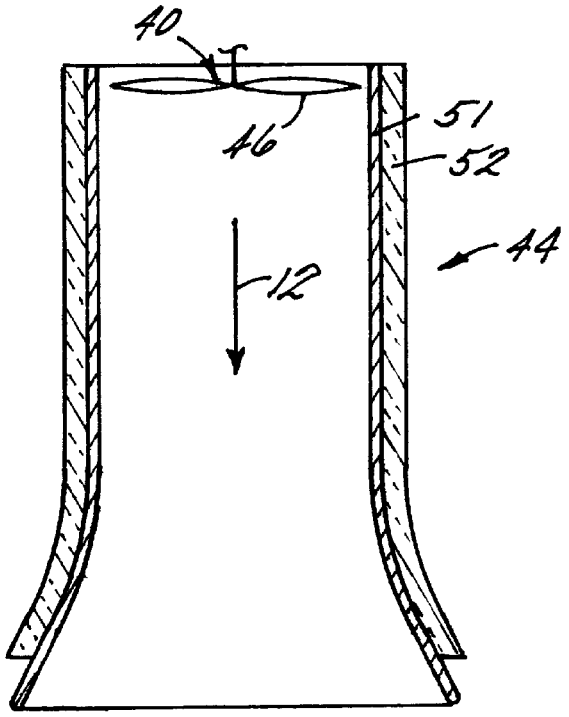
FIG. 3 is a side elevational view of an embodiment of a modulator of the hand dryer of FIG. 1.

As shown in FIGS. 1 and 3, the heated air stream 12 exiting the heater 34 passes through a modulator 40 that is mounted thereto. The modulator modulates, interrupts and alternately directs the air flow passing therethrough to an input opening 42 of an air duct 44. The modulated air stream 12 enhances the evaporation of the water by breaking down the boundary layer on the user's hands 14.

Figure 4:
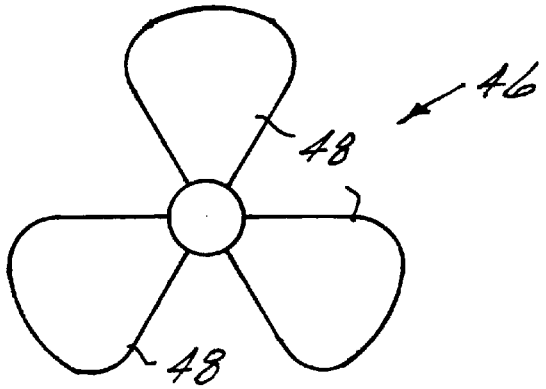
FIG. 4 is a bottom plan view of the modulator of FIG. 3.

The modulator 40 includes a fan or propeller 46 disposed axially to the air duct 44. The fan 46 may freely rotate about its axis and therefore, the rate of rotation of the fan is proportional to the flow rate to the airstream 12 through the duct 44. As shown in FIG. 4, the propeller 46, preferably has three lobes or blades 48 which partially block the air stream 12 as it rotates so that the heated air impinging on the wet hands 14 is pulsed, thus helping to reduce the stagnation boundary layers and increase the rate of evaporation. Alternatively, the fan 46 may be driven by a motor to control the rate of rotation, and thus control the frequency of the pulsed or modulated air stream 12. The pulses may be in a variety of formats ranging from on-off to superimposed pulses on a steady air stream column to alternate monolithic columns of air.

As shown in FIG. 1, the air duct 44 directs the heated air stream 12 to an exit nozzle 50. The air duct 44 is formed of thin sheet material 51, such as plastic or metal, that has a low total specific heat and low mass, capable of withstanding the hot temperature of the air provide by the heater 34. The characteristics of the sheet material allow the duct 44 to heat up quickly and therefore, has a negligible cooling effect on the heated air stream 12.

The air duct 44 also includes an external thermal insulative liner or layer 52 to retain the heat within air duct and prevent radiant cooling of the air stream 12. The insulation liner 52 can be foam or an outer duct spaced from the air duct. The sheet material 51 can also be made of porous plastic which will absorb little heat from the heated air. The insulative liner 52 and sheet material 51 of the air duct 44 maintains the heat energy within the heated air stream 12 rather than being diverted into heating the dryer chamber 30. An insulation layer (not shown) may also line the internal surface of the duct.

Figure 5:
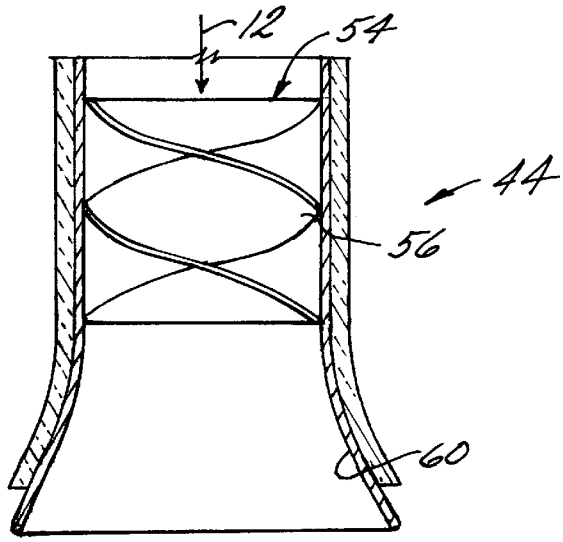
FIG. 5 is a front elevational view of a turbulator of the hand dryer shown in FIG. 1.

The air duct 44 also includes a turbulator portion 54 disposed at the output opening of the air duct to turbulate the heated air exiting the duct. As shown in FIG. 5, the turbulator portion 54 of the air duct includes an axially twisted vane 56. The twisted vane is spiral-shaped or convoluted to interrupt the modulated laminar flow of the air passing through the duct 44. The resulting turbulent air aids with the break down and eroding of the boundary layer 16 (see FIG. 2) disposed on the user's hands 14. The turbulator 54 also functions to distribute evenly the temperature cross section of the heated air to ensure that the air stream 12 does not have a hotter core region than the surrounding circumferential region so that the core temperature does not exceed the allowable 170° F. defined by Federal Standards. An air stream 12 having an evenly distributed air flow temperature allows for more effective temperature optimization for better water evaporation without the danger of burning the user's hands 14.

Figure 6:
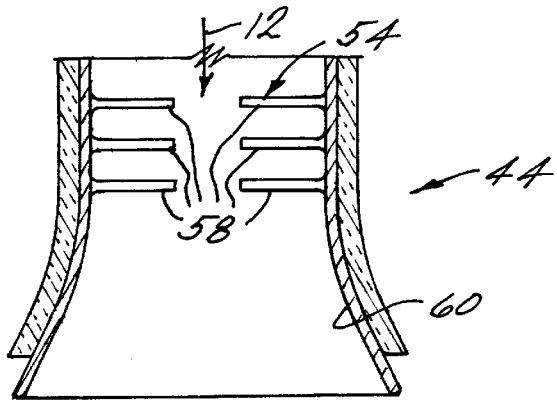
FIG. 6 is a front plan view of first alternative embodiment of the turbulator of the hand dryer shown in FIG. 1.

FIG. 6 illustrates an alternative embodiment of the turbulator portion 54 of the air duct 44, wherein arrays of projections 58 extending from the inner surface 60 of the air duct to turbulate the exiting air stream 12. The projections 58 may be in the form of fingers or vanes projecting into the air flow, or flexible strips that can flutter in the air stream.

Figure 7:
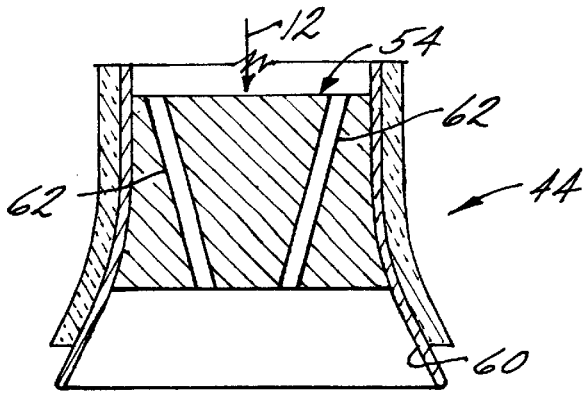
FIG. 7 is a front plan view of second alternative embodiment of a turbulator of the hand dryer shown in FIG. 1.

FIG. 7 illustrates yet another embodiment of the turbulator portion 54 of the air duct 44. The turbulator portion of the air duct includes a pair of channels 62 that split the air stream 12. The channels 62 are angled inwardly to impact each other to mix or turbulate the air. Further, this embodiment may include a plurality of channels that are angled to impact the air flow from opposing channels.

Referring to FIG. 1, the hand dryer 10 may include an exit nozzle 50 that may be disposed adjacent the exit of the air duct 44. The exit nozzle 50 may be formed of a metal sheath, generally chromium plated for aesthetic purposes, which the user may turn so as to direct the air to either his face or hands. The inner surface of the nozzle 50 may be lined with insulating material 64 that is both rigid and capable of surviving maximum air stream temperatures. The insulative material 64 may be formed of porous durable plastic and may project outward beyond the metal sheath to prevent accidental hand 14 contact with harmful hot surfaces at the outer edge of the nozzle 50. It is necessary for the projecting end of the insulation 64 to be hard and rigid so as not to deteriorate with years of use. Insulation 64 serves the additional function of muffling noise that may result from the high velocity air stream exiting the nozzle that may consist of jets.

Figure 8:
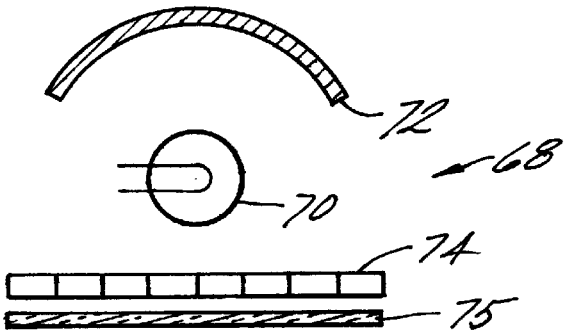
FIG. 8 is a front plan view of an infrared heating device of the hand dryer shown in FIG. 1.

As shown in FIGS. 1 and 8, the hand dryer 10 includes an infrared (IR) heating device 68 disposed preferably adjacent exit nozzle 50 so that the infrared heat has a direct optical path to the user's hands 14. The infrared heating device 68 comprises an infrared heating source 70 such as nichrome, silicon carbide, infrared laser diodes, halide lamps, tungsten diode, arc lamps, tungsten filament lamps, or infrared heat lamps. A reflector 72 disposed behind the heating source 70 reflects the heat to the user's hands 14. The IR reflector 72 is made of metal or glass or plastic with reflective coatings. A shield 74, disposed forward of the heat source 70 prevents physical contact with the heat source by the user. The shield 74 may be a wire or plastic grid, or infrared transparent glass or quartz. Since shield 74 can become hot, a second transparent protective shield 75 is employed. Its secondary function is that it can filter the light to pass both infrared as well as a pleasing visible color. This will form an illuminated colored pattern on the hands which will indicate to the user where to place his hands for optimum speed of drying and for avoidance of touching of the wall on which the dryer is mounted to eliminate contamination.

The infrared radiation on the user's hands 14 is used to help replace the heat lost by rapid evaporation of the water from the hands. The evaporation of a liquid to a gas requires the investment of a certain quantity of energy which is different for each chemical species. The energy required to evaporate 2.5 grams of water (typically found on wet hands) is 5.5 Btu, which in theory is all the energy that need be dissipated in a hand dryer heating element in order to dry a pair of wet hands. However, more energy is necessary because of the countering effect of the temperature drop due to the heat of evaporation on the hand surface.

The heat of evaporation causes some of the heat that vaporizes the water to come not from the hot air stream 12 but from the hands 14 themselves, and thus cooling the skin surface of the hands. This cooling effect cools the air stream 12 as well, thus lowering the air streams ability to evaporate water from the hands.

To compensate for this local temperature decrease, the infrared heating device replaces the energy extracted from the hands as a result of evaporation by heating the surface of the hands. The infrared heating source 70 provides the added energy without having to increase the temperature or flow rate of the heated air stream 12 which is already as hot and fast as comfortably possible.

Referring to FIG. 1, in addition to the heater temperature sensor 36, the hand dryer 10 further includes a second temperature sensor 76 mounted at the output opening of the air duct 44 to monitor the exit temperature of the heated air stream 12. According to Federal Standards, the output temperature of the air flow may not exceed 170° F. Temperature sensor 76 provides a signal to the controller 38 which in turn de-energizes the heater 34 if the exit temperature of the air stream 12 exceeds a predetermined temperature to prevent injury or discomfort to the user, and at the same time maintain the temperature at a more effective drying temperature.

The temperature sensors 36, 76 may include a thermistor, a thermocouple or bimetallic switch. A thermistor and thermocouple generates a signal proportional to the temperature of the air stream 12, while the bimetallic switch provides a signal to the controller 38 indicative of the air flow exceeding a predetermined temperature. The bimetallic switch comprises a pair of strips bonded together, wherein the metals have different coefficients of thermal expansion so that the bonded strips bend as temperature changes. When the temperature exceeds the rated temperature, the switch opens. It will be recognized that the bimetallic switch may be connected in series with the control signal at 78 (see FIG. 1) that energizes the heater 34, rather than provide a signal to the controller 38. Therefore, when the air stream temperature exceeds the predetermined temperature, the bimetallic switch will open and directly interrupt the power to the heater 34.

Air stream temperature is crucial for increasing speed of drying since with each degree Fahrenheit of temperature increase, the capability for carrying water vapor in a cubic foot of air increases by about 0.08 grams. The air stream 12 in a conventional hand dryer 10 is driven at a volume rate of about 3 cubic feet per second. Thus, ideally, with this air flow rate, each degree of temperature increase will increase drying capacity by about a quarter of a gram per second. Typically, air streams 12 normally arrive at the hands 14 at a distance of about six inches from the nozzle 50 from which the warmed air stream exits at about 115° F. Boosting the exit temperature by 20° F. will significantly reduce the drying time, without causing discomfort to the user.

The conventional dryers heat the air stream 12 at a cooler temperature because the temperature of the nozzle 50, made of high conductivity chrome plated steel, becomes too high to touch. Generally, there is a 20° F. temperature drop in the air stream 12 from nozzle 50 to hands 14 which means the air stream should emerge from the nozzle at least 155° F. for it to be 135° F. at the hands. As described hereinbefore, the present invention provides insulative material 64 extending from the exit nozzle 50 to keep the touchable portions of the metal nozzle at 135° F. or cooler, while the exiting air temperature is approximately 155° F.

Referring to FIG. 1, the hand dryer includes a dryer actuation device 80, such as a conventional manual push button switch that the user depresses to actuate the dryer 10 for the predetermined time period. When depressed, the manual switch generates an actuation signal that is provided to the controller 38 which initiates the hand dryer 10. The manual switch can be operated by the pressure from the user by arm or elbow, or body pressure, without the need for using wet hands.

Referring to FIG. 1, the actuation signal to initiate the operation of the hand dryer 10 may be provided by a hand proximity sensor 82 and/or a body proximity sensor 84 to sense when the user's hands 14 are in position to be dried. The proximity sensors 82, 84 may be of the photoelectric, capacitance or ultrasonic type sensors. The photoelectric proximity sensor uses a source of light such as infrared or visible light beam (preferably from a solid state light emitting diode, LED), and a photodetector to sense a reflected light beam. When an object such as a user approaches the hand dryer 10 and/or the hands 14 are placed below the nozzle 50 of the hand dryer 10, the light beam is reflected off the user and/or hands, and is detected by the proximity sensor 82, 84. The proximity sensor amplifies the reflected signal and generates an actuation signal to the controller 38 which energizes the hand dryer 10.

To prevent false actuation of the controller 38 having proximity switches 82, 84, optical filters and/or wavelength specific sources and detectors are used to help ignore other sources of light.

The capacitance type sensor measures the change of capacitance to an electrode as a result of the change of the measured capacitance when a body or object approaches the capacitance electrode. The change of capacitance can be used to unbalance an impedance bridge, or to change the frequency of an oscillator. Such techniques are well known to those skilled in the art of electronics.

The body proximity sensor 84 is mounted in the housing 20 to project outwardly from the hand dryer 10 to detect the approach of a user of the hand dryer. The detection range of the body proximity sensor 84 should extend approximately 1 foot from the hand dryer 10 so as to not actuate the hand dryer when a person is simply passing by.

In response to an actuation signal from the body proximity sensor 84, the controller 38 energizes the heater 34 to preheat the air within the hand dryer 10 before energizing the blower 32. Preheating of the air can save drying time by energizing the heater before the hands are placed in the drying position, and thus reduce the time to heat the air to its maximum drying temperature.

The hand proximity sensor 82 is mounted in the housing 20 to project downwardly from the hand dryer 10 for detecting the placement of the user's hands 14 below the exit nozzle 50 for drying. The detection range of the hand proximity sensor 82 extends approximately 6 inches from the exit nozzle 50. In response to an actuation signal from the hand proximity sensor 82, the controller 38 energizes the blower 32, modulator 40 and infra-red heating device 68 to begin the drying process.

Figure 9:
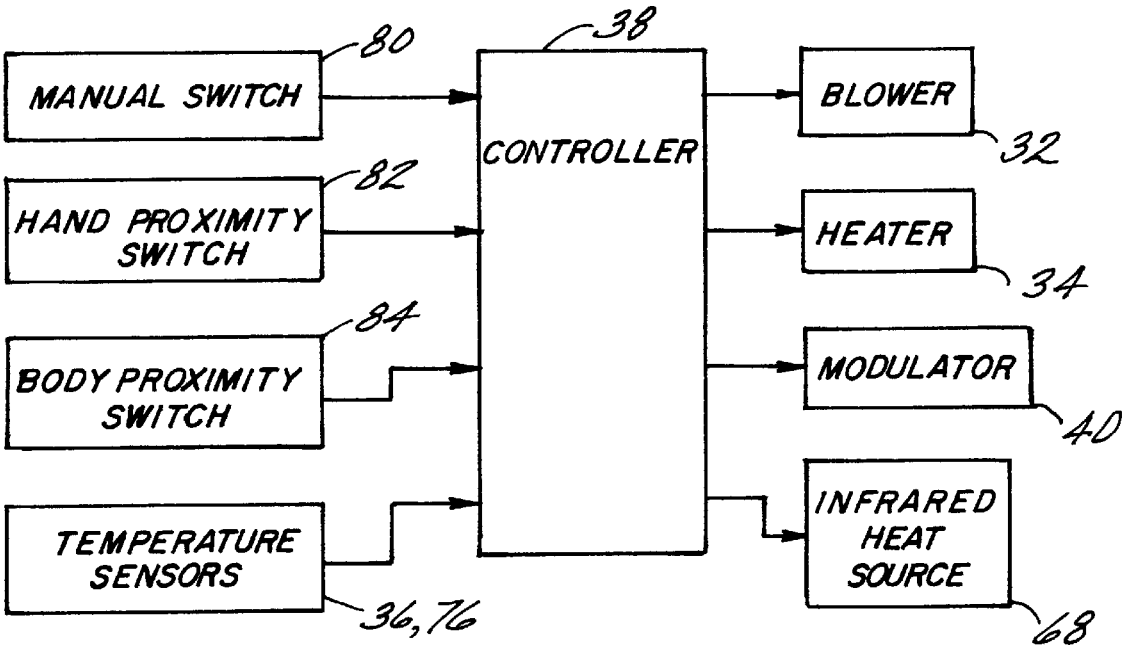
FIG. 9 is a block diagram of the hand dryer of FIG. 1 illustrative of the operation of the controller.

As shown in FIGS. 1 and 9, the controller 38 controls the operation of the heater 34, the blower 32, the modulator 40 and the infrared heating device 68 in response to signals provided by the heater temperature sensor 36, the exit temperature sensor 76, the actuation device 80 and/or proximity sensors 82, 84. In a preferred embodiment, the controller includes a microprocessor (or microcontroller), a timer, and memory for storing a software program for controlling the operation of the hand dryer 10. The controller 38 further includes switches that are actuated to energize the blower, heater, infrared heating device and modulator.

In the operation of the hand dryer 10, the controller 38 provides power to the heater 34, the blower 32, the IR heating device 68 and the modulator 40 for a preset drying time (i.e., 10 seconds) in response to an actuation signal provided by the push-button switch 80 and/or proximity sensors 83, 84. The controller monitors the elapsed time after receiving the actuation signal and will turn off the drying power after the preset drying time.

The controller 38 may also provide a standby mode, wherein the heater 34 is maintained at a reduced power level for a predetermined time period (i.e., 1 hour) after each use of the hand dryer 10. Alternatively, the heater may be maintained in a standby mode during a predefined period of the day during normal periods of high hand dryer usage, such as between 10:00 am to 5:00 pm.

As described hereinbefore, the actuation of the hand dryer 10 may be provided by a hand proximity sensor 82 and a body proximity sensor 84. When a user approaches to use the hand dryer 10, the body proximity sensor 84 provides an actuation signal to the controller 38. In response to this actuation signal, the controller provides full power to the heater 34 to pre-heat the heater and air in the air duct 44 of the hand dryer 10.

The hand proximity sensor 82 then detects the presence of a user's hands 14 below the exit nozzle 50 of the hand dryer 10 and generates a second actuation signal. The controller 38 then energizes the blower 32, the IR heating device 68 and the modulator 40 in response to the actuation signal provided by the hand proximity sensor 82. When the user steps away from the hand dryer, the action signals are no longer present, and therefore, the controller de-energizes the blower, modulator, IR heating device and reduces the heater 34 to the standby mode for the predetermined time period.

The controller 38 also monitors the temperature of the heater 34 and the air stream 12 at the exit nozzle 50 and controls the energization of the heater accordingly. If either temperature sensor 36, 76 exceeds a predetermined temperature, the controller de-energizes the heater 34 until the temperature drops to a predetermined temperature, at which time the heater is re-energized. This cycling of the heater allows the controller to maintain the temperature of the heater 34 and air flow 12 to any desired safe temperature range.

The practice and use of control electronics are well known to those skilled in the art. One skilled in the art will appreciate that, while the controller is shown to utilize a software program, the control circuit may perform the same functions using analog and digital components.

Figure 10:
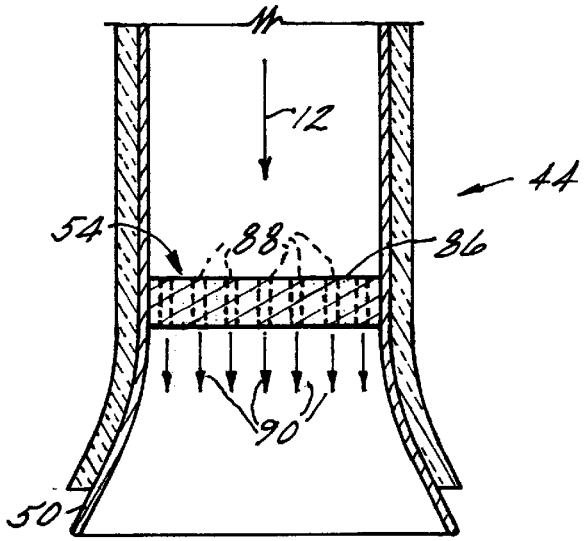
FIG. 10 is a front elevational view of third alternative embodiment of a turbulator of the hand dryer shown in FIG. 1.

FIG. 10 illustrates an alternative embodiment of the present invention wherein all like components of the previous embodiment of FIG. 1 of the present invention have the same reference numerals. The hand dryer 10 of FIG. 3 substitutes the modulator 40 and turbulator section 54 of the air duct 44 with a perforated disk 86 having a plurality of channels 88 disposed therethrough. The channels 88 may be of any shape, such as circular, square or rectangular. The disk 86 is mounted fixedly within the air duct 44 at the output opening of the air duct.

The perforated disk 86, converts a monolithic air stream 12 from the blower 32 to an array of jets 90 made up of faster moving air by passing the air stream through its channels 88. A slightly larger air blower 32 is used to compensate for increased air resistance caused by the air passing through the channels. To ensure good jet formation, the length of the channel will be greater than its diameter by a factor of approximately three.

The perforated disk 86 generates an array of steadily flowing air jets 90 having significantly higher velocity than the velocity of a monolithic single stream 12 of air while having the same total volume air flow rate. The increased turbulence occurs as a consequence of the force of impact of each jet on the surfaces of the wet hands 14 to break up the boundary layer 12 (FIG. 2) of the water on the hands. Additionally, these jets 90 will knock some loose droplets of water off the hands.

The perforated disk 86 may, for example, include 100 perforations each of 1/32" diameter, resulting in up to a 40 times increase of air velocity within each tiny jet stream 90 so long as sufficient blower pressure is maintained. (This results from the fact that each such jet 90 has an area of 0.0008 $in^2$ resulting in a composite area of 0.08 $in^2$ for the 100 jets. Since the face area of the conventional nozzle 50 is about 3.2 $in^2$, there will be a lessening of total air stream area of up to a maximum of 40 times.) This higher velocity will cause the jets to hit the wet hands 14 with markedly higher impact than is conventional and will thus partially or wholly degrade the boundary layer 16. Additionally, as the jets 90 collide with each other at the hand surface, yet more turbulence will occur, also enhancing boundary layer degradation. A secondary benefit is that some loose droplets of water will simultaneously be knocked off the wet hands.

Figure 11:
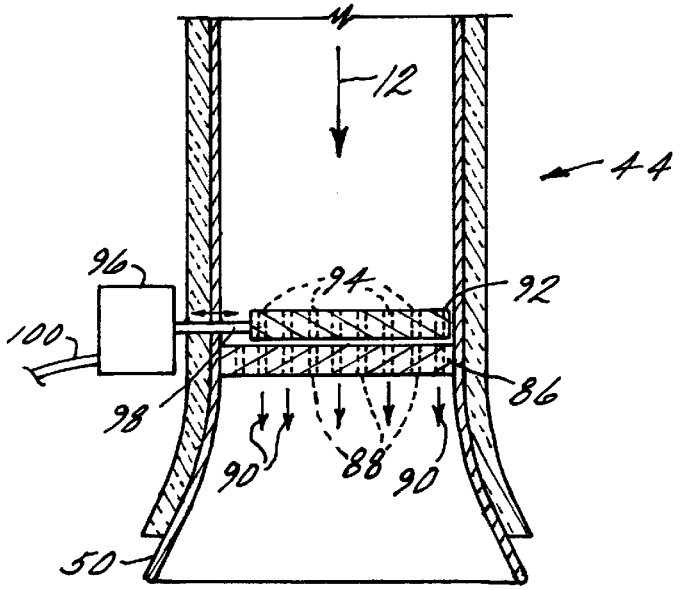
FIG. 11 is a front elevational view of an alternative embodiment of the turbulator and modulator of the hand dryer shown in FIG. 1.
Figure 12:
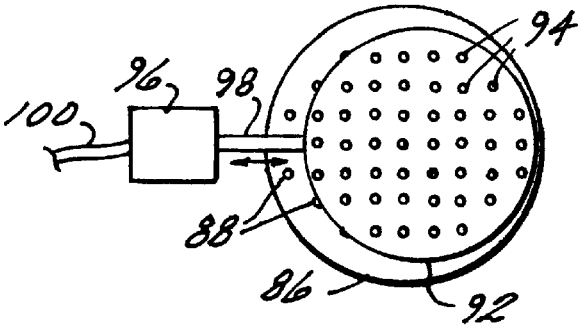
FIG. 12 is a top plan view of an alternative embodiment of the turbulator and modulator of the hand dryer shown in FIG. 11.

As shown in FIGS. 11 and 12, a second disk 92 may be movably mounted adjacent the fixed perforated disk 86 to provide a pulsating action to the air jets 90 exiting the perforated disk 86. The second disk 92 has a diameter less than that of the fixed disk 86 to permit movement of the second disk within the air duct 44. The second disk has a matching array of channels 94 in size and location as the fixed perforated disk 86. A solenoid 96, interconnected to the second disk 92 by a rod 98, indexes laterally the second disk above the fixed disk 86 resulting in the pulsation of the air jets 90. The movement of the second disk 92 will allow air to flow through the disks 86, 92 when the channels 88, 94 are aligned and blocked when, with a small lateral movement, the channels are not aligned.

Rapidly moving air passing through perforations 86 may produce noise which can be reduced by variations in the shape of the perforation along its length and by lining the exit port with a sound absorbing material such as a plastic foam or silicone. This becomes a second function of the thermal insulator 64.

The controller 38 provides a signal at 100 to actuate the solenoid 96. The frequency of the indexing of the second disk 92 is controlled by the controller. One skilled in the art will appreciate that a motor driven cam can be substituted for the solenoid 96. Further, the air stream 12 may be pulsed, either in monolithic or jet form, using a flutter valve or a fluidic valve.

Figure 13:
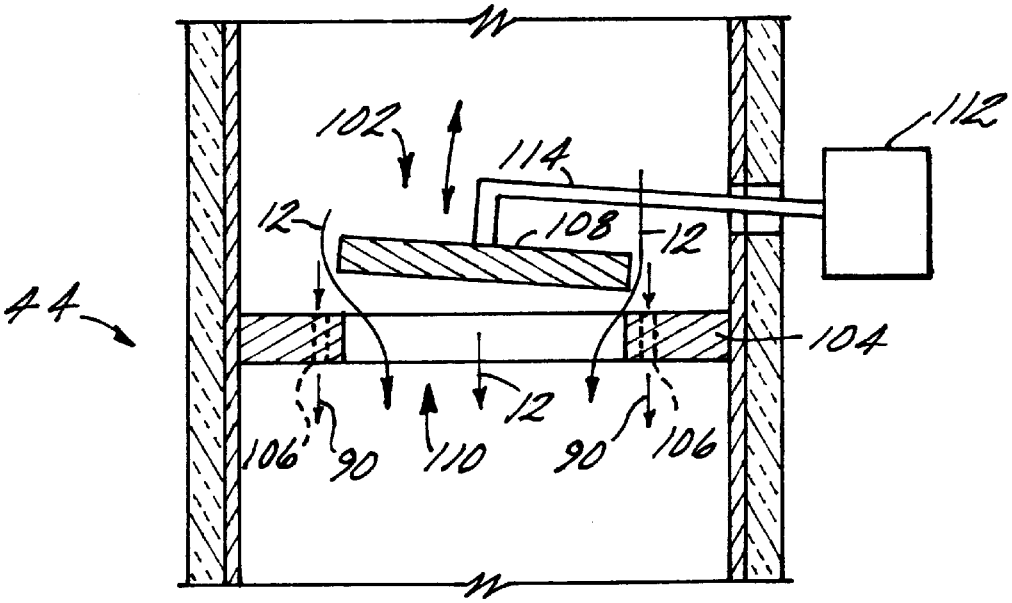
FIG. 13 is a front elevational view of second alternative embodiment of the turbulator and modulator of the hand dryer shown in FIG. 1.

Referring to FIG. 13, another embodiment of a jet pulsating device 102 at the output opening of the air duct 44 is shown. The pulsating device includes an annular plate 104 secured within the air duct 44. The annular plate 104 includes a plurality of jet forming perforations 106 arranged in a circle around the plate. The pulsating device 102 further includes a closure plug 108 having a diameter slightly larger than a central vent or opening 110 of the annular plate 104. A solenoid 112, interconnected to the plug by a rod 114, oscillates the plug up and down in response to a signal provided by the controller 38 to reiteratively open and close the central vent 110.

The central vent 110 is of such large area that when it is open, virtually all the air stream 12 flows through it and virtually no air stream passes through the jet perforations 106 because the small perforations present a relatively large resistance to air flow when compared to the relatively small resistance to air flow of the central vent 110. However, when the central vent 110 is closed with the closure plug 108, the air stream 12 passes through perforations 106 and emerges as high velocity air jets 90. This sequence of alternating high velocity air jets and a monolithic air stream provides a complex pattern of pulsing to effectuate barrier layer degradation as well as blowing off of loose droplets of water.

Figure 14:
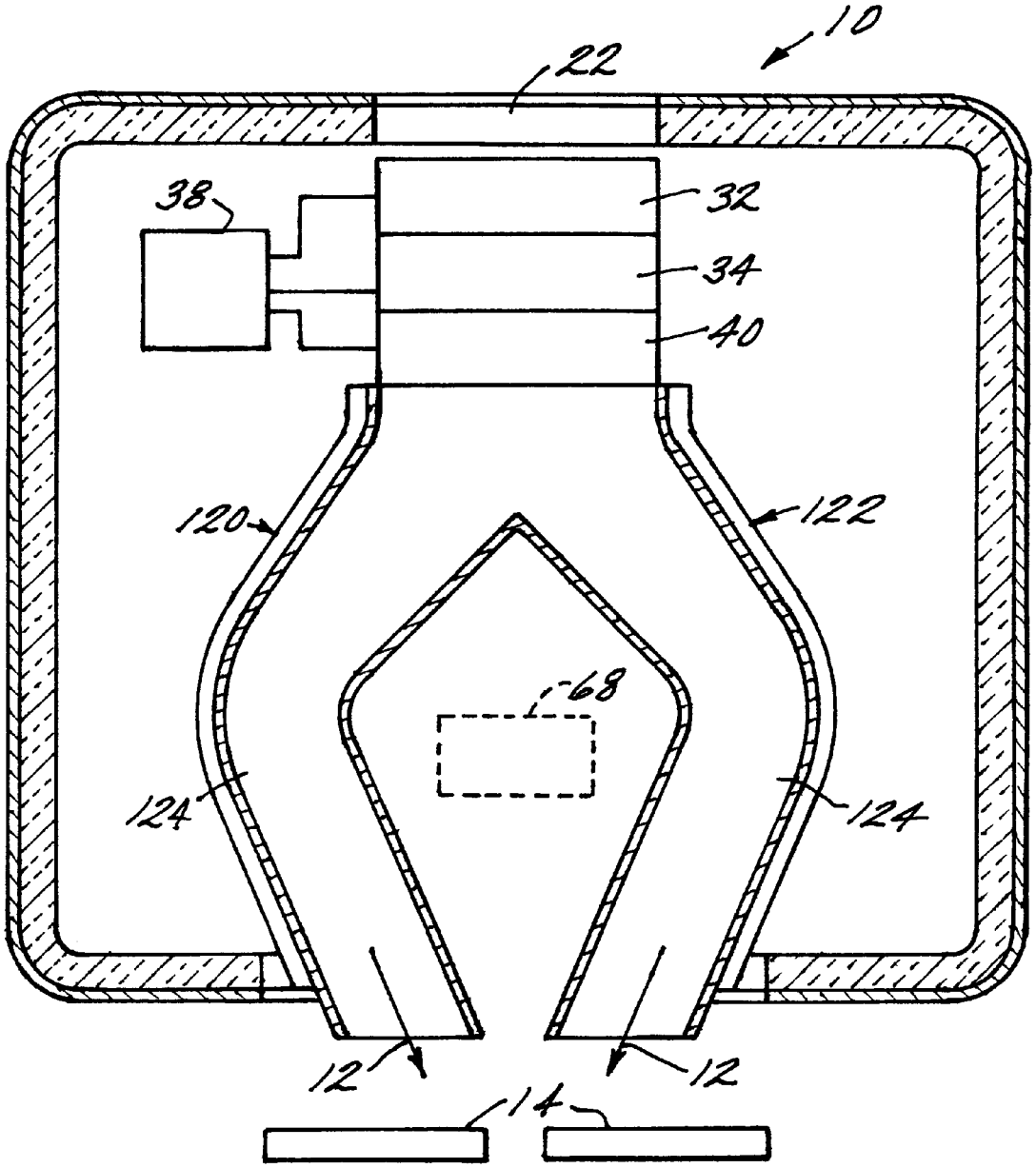
FIG. 14 is another alternative embodiment of the hand dryer embodying the present invention having dual air ducts.

FIG. 14 illustrates an alternative embodiment of the present invention wherein all like components of the previous embodiment of FIG. 1 of the present invention have the same reference numerals. The air stream 12 splits between a pair of diverging air ducts 120, 122. The ends 124 of the air ducts bend inwardly to direct the air streams inwardly to collide with each other to create sufficient turbulence to erode or break down the boundary layer 16 (FIG. 2) of water vapor on the user's hands 14. The angle of collision is tangential to the surface of the user's hands, approximately between 15 and 45 degrees. The colliding air streams 12 or portions can be in different forms such as but not limited to a slit geometry or a circular geometry.

The remaining components of the embodiment shown functions in similar manners as the like components of FIG. 1 as described hereinbefore but are oriented as to cause two air streams to emerge from the device at an angle such as to impact on each other as they strike the wet hands 14. This impact enhances turbulence and thus the destruction of the boundary layer. Further, these air streams 12 impinge on the wet hands 40 at an angle to the tangent surface so that the horizontal and vertical components of the hot air flow help blow off any loose water to reduce the amount of water that needs to be evaporated.

Figure 15:
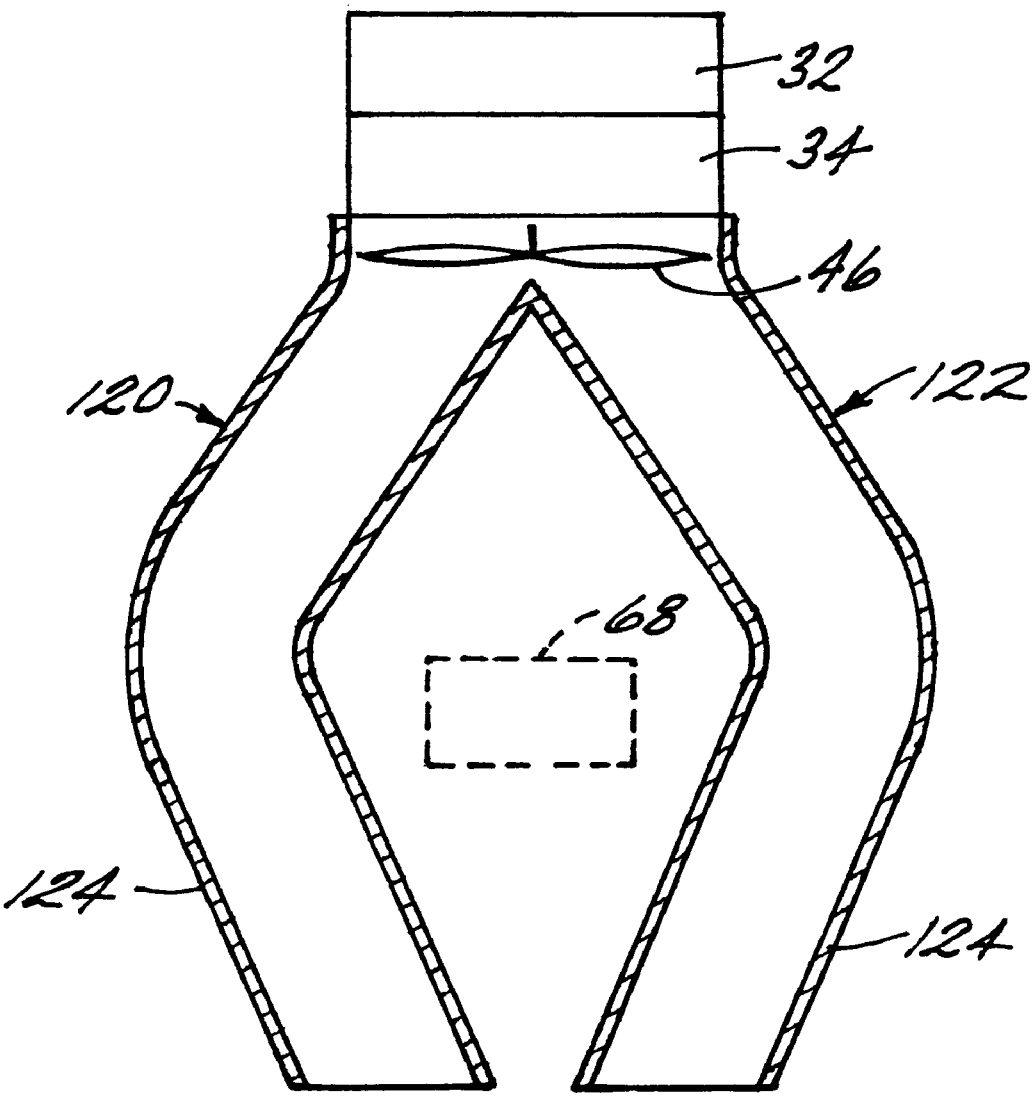
FIG. 15 is an exploded front elevational view of a portion of the hand dryer in FIG. 15.

Referring to FIG. 15, the modulator 40 may include a fan 46 similar to that shown in FIG. 4. The fan is positioned at the input of the dual ducts 120, 122 such that a lobe 48 of the fan 46 alternately blocks or partially blocks the opening of the ducts as the fan rotates. This action produces an alternating or modulating air stream 12 from the air ducts 44. An LCD visual display, electronically controlled, will be located on the outside top of the dryer shell 20. It will be used in a number of display modes as for example, digital countdown of drying in seconds, cartoon characters, advertising, games, etc.

The shape of the nozzle 50 may be widened so that the airstream made up of high velocity turbulated jets impacts the hands in a spread pattern with the result that both hands are dried at once rather than sequentially.

An alternative embodiment to providing a standby mode includes a pressure chamber, independently heated to air stream temperature and filled with compressed air which expands to three cubic feet under standard conditions of pressure and temperature.

In another alternative embodiment the air entering the hand dryer 10 can have its moisture content reduced by means of first passing over surfaced cooled by a refrigerator stage. In normal humidity in most climates this will increase the moisture carrying ability of the air by as much as 5%. Others have used regenerating desiccant systems for this purpose.

While the above-described invention relates to a hand dryer, one skilled in the art will recognize that the present invention may be used to dry any number of surfaces, such as one's hair, arms and body.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A dryer comprising:

a duct having an input opening and an output opening;

a blower unit disposed in fluid communication with said duct for generating an air flow from said output opening of said duct;

a heater disposed in fluid communication with said duct for heating said air flow;

a modulator for varying the flow rate of said air flow through said duct;

a control circuit for energizing said blower and heater in response to an actuation signal, and a turbulator disposed adjacent said output opening of said duct for mixing said air flow.

2. The dryer, as defined in claim 1, wherein the modulator comprises:

a rotatable fan having a plurality of blades, whereby the blades interrupt the laminar air flow as the fan rotates.

3. The dryer, as defined in claim 2, wherein the rotatable fan is rotated at varying selected rates.

4. The dryer, as defined in claim 1, wherein the modulator comprises:

an annular shoulder disposed about an inner wall of said duct, said shoulder having a central opening;

a disk disposed adjacent the central opening; and an actuator attached to said disk for reciprocating said disk in a generally axial direction to an open and close the central opening.

5. The dryer, as defined in claim 4, wherein the annular shoulder has a plurality of axial through bores disposed therein.

6. The dryer, as defined in claim 1, further includes a fixed plate having a plurality of through bores disposed therein, whereby air passing through said through bores to form air jets.

7. The dryer, as defined in claim 6, wherein the fixed plate has converging through bores for impinging said air jets.

8. The dryer, as defined in claim 1, wherein the modulator comprises:

a fixed plate having a plurality of through bores disposed therein;

a movable plate disposed adjacent said fixed plate, said movable plate having a plurality of through bores disposed therein; and an actuator for reciprocating the movable plate radially, whereby air variably communicates through said through bores of both said fixed plate and said movable plate as the movable plate reciprocates which generates a plurality of pulsed air jets.

9. The dryer, as defined in claim 1, wherein an inner wall of said duct at said output opening is insulated.

10. The dryer, as defined in claim 1, wherein the heater is disposed down stream of the air flow from the blower.

11. The dryer, as defined in claim 1, wherein the duct is insulated about an outer surface of said duct.

12. The dryer, as defined in claim 1, wherein the turbulator comprises a twisted vane disposed in said duct.

13. The dryer, as defined in claim 1, further includes an infrared heater adjacent said output opening of said duct to provide radiant heat to a drying surface.

14. The dryer, as defined in claim 1, wherein the control circuit continues to energize said heater for a predetermined time period after said blower is de-energized.

15. The dryer, as defined in claim 1, further includes a temperature sensor for generating a temperature signal representative of the temperature of the air flow at said output opening of said duct, whereby said control circuit energizes said heater to maintain a predetermined temperature at said output opening.

16. The dryer, as defined in claim 1, further comprising a proximity sensor that provides an actuation signal when a user is within a predetermined range.

17. The dryer, as defined in claim 1, further comprising a pair of ducts, each of which having an input opening and an output opening, whereby said output openings oppose each other at a predetermined angle.

18. The dryer as defined in claim 1, further comprising an insulated housing for enclosing said blower, heater, duct and modulator.

19. A dryer comprising:

a duct having an input opening and an output opening;

a blower unit disposed in fluid communication with said duct for generating an air flow from the output opening of said duct;

a heater disposed in fluid communication with said duct for heating said air flow;

a turbulator disposed adjacent said output opening of said duct for mixing said air flow; and a control circuit for energizing the blower and heater in response to an actuation signal.

20. The dryer, as defined in claim 19, wherein the turbulator comprises a twisted vane disposed in said duct.

21. The dryer, as defined in claim 19, further includes a modulator for varying the flow rate of the air flow through said duct.

22. The dryer, as defined in claim 21, wherein the modulator comprises:

a rotatable fan having a plurality of blades, whereby the blades interrupt the laminar air flow as the fan rotates.

23. The dryer, as defined in claim 21, wherein the modulator comprises:

an annular shoulder disposed about an inner wall of said duct, said shoulder having a central opening;

a disk disposed adjacent the central opening; and an actuator attached to said disk for reciprocating said disk in a generally axial direction to an open and close the central opening.

24. The dryer, as defined in claim 23, wherein the annular shoulder has a plurality of axial through bores disposed therein.

25. The dryer, as defined in claim 21, wherein the modulator comprises:

a fixed plate having a plurality of through bores disposed therein;

a movable plate disposed adjacent said fixed plate, said movable plate having a plurality of through bores disposed therein; and an actuator for reciprocating the movable plate radially, whereby air variably communicates through said through bores of both said fixed plate and said movable plate as the movable plate reciprocates which generates a plurality of pulsed air jets.

26. The dryer, as defined in claim 19, wherein the heater is disposed down stream of the air flow from the blower.

27. The dryer, as defined in claim 19, further includes an infrared heater adjacent said output opening of said duct to provide radiant heat to a user's hands.

28. The dryer, as defined in claim 19, wherein the control circuit continues to energize said heater for a predetermined time period after said blower is de-energized.

29. The dryer, as defined in claim 19, further includes a temperature sensor for generating a temperature signal representative of the temperature of the air flow at said output opening of said duct, whereby said control circuit energizes said heater to maintain a predetermined temperature at said output opening.

30. The dryer, as defined in claim 19, further comprising a proximity sensor that provides an actuation signal when a user is within a predetermined range.

31. The dryer, as defined in claim 19, further comprising a pair of ducts, each of which having an input opening and an output opening, whereby said output openings oppose each other at a predetermined angle.

32. The dryer as defined in claim 19, further comprising an insulated housing for enclosing said blower, heater, duct and modulator.

33. A dryer comprising:

a duct having an input opening and an output opening;

a blower unit disposed in fluid communication with said duct for generating an air flow from the output opening of said duct;

a heater disposed in fluid communication with said duct for heating said air flow;

a plate having a plurality of through bores disposed therein, whereby air passing through said through bores to form air jets;

a control circuit for energizing the blower and heater in response to an actuation signal;

a movable plate disposed adjacent said plate, said movable plate having a plurality of through bores disposed therein; and an actuator for reciprocating the movable plate radially, whereby air variably communicates through said through bores of both said plate and said movable plate as the movable plate reciprocates which generates a plurality of pulsed air jets.

34. The dryer, as defined in claim 33, further comprises a turbulator disposed adjacent said output opening of said duct for mixing said air flow.

35. The dryer, as defined in claim 34, wherein the turbulator comprises a twisted vane disposed in said duct.

36. The dryer, as defined in claim 33, further includes a modulator for varying the flow rate of the air flow through said duct.

37. The dryer, as defined in claim 36, wherein the modulator comprises:

a rotatable fan having a plurality of blades, whereby the blades interrupt the laminar air flow as the fan rotates.

38. The dryer, as defined in claim 36, wherein the modulator comprises:

an annular shoulder disposed about an inner wall of said duct, said shoulder having a central opening;

a disk disposed adjacent the central opening; and an actuator attached to said disk for reciprocating said disk in a generally axial direction to an open and close the central opening.

39. The dryer, as defined in claim 38, wherein the annular shoulder has a plurality of axial through bores disposed therein.

40. The dryer, as defined in claim 33, wherein the plate has converging through bores for impinging said air jets.

41. The dryer, as defined in claim 33, wherein the heater is disposed down stream of the air flow from the blower.

42. The dryer, as defined in claim 33, further includes an infrared heater adjacent said output opening of said duct to provide radiant heat to a user's hands.

43. The dryer, as defined in claim 33, wherein the control circuit continues to energize said heater for a predetermined time period after said blower is de-energized.

44. The dryer, as defined in claim 33, further includes a temperature sensor for generating a temperature signal representative of the temperature of the air flow at said output opening of said duct, whereby said control circuit energizes said heater to maintain a predetermined temperature at said output opening.

45. The dryer, as defined in claim 33, further comprising a proximity sensor that provides an actuation signal when a user is within a predetermined range.

46. The dryer, as defined in claim 33, further comprising a pair of ducts, each of which having an input opening and an output opening, whereby said output openings oppose each other at a predetermined angle.

47. The dryer as defined in claim 33, further comprising an insulated housing for enclosing said blower, heater, duct and modulator.

48. A dryer comprising:

a pair of ducts, each of which having an input opening and an output opening, whereby said output openings opposing each other at a predetermined angle, said predetermined angle being less than 180 degrees;

a blower unit disposed in fluid communication with said duct for generating an air flow from the output opening of said ducts, said air flow from each of said ducts colliding to create turbulence;

a heater disposed in fluid communication with said duct for heating said air flow; and a control circuit for energizing the blower and heater in response to an actuation signal.

49. The dryer, as defined in claim 48, further includes an infrared heater adjacent said output opening of said ducts to provide radiant heat to a user's hand.

* * * * *